United States Patent [19]

Neff

[11] Patent Number: 4,579,042

[45] Date of Patent: Apr. 1, 1986

[54] SELECTIVE AIR PRESSURE CONTROL SYSTEM FOR WELDING AND LIKE APPARATUS

[75] Inventor: James A. Neff, Bloomfield Township, Oakland Co., Mich.

[73] Assignee: Mac Valves, Inc., Wixom, Mich.

[21] Appl. No.: 602,410

[22] Filed: Apr. 20, 1984

[51] Int. Cl.[4] ..... F15B 11/08

[52] U.S. Cl. ..... 91/446; 91/448; 91/459; 91/461

[58] Field of Search ..... 91/446, 448, 461, 459, 91/444; 137/495, 505, 552.5, 624.11, 505.42

[56] References Cited

U.S. PATENT DOCUMENTS

| | | | |
|---|---|---|---|
| 3,113,756 | 12/1963 | Griffo | 137/505.42 |
| 3,222,997 | 12/1965 | Blatt et al. | 91/448 X |
| 3,796,135 | 3/1974 | Lekarski et al. | 91/461 |
| 4,020,862 | 5/1977 | Bohnlein et al. | 137/552.5 X |
| 4,044,653 | 8/1977 | Aoki | 91/459 X |
| 4,072,087 | 2/1978 | Mueller | 91/461 |
| 4,253,379 | 3/1981 | Olson | 91/446 X |
| 4,463,656 | 8/1984 | Mattsson | 91/446 X |
| 4,478,131 | 10/1984 | Liermann et al. | 91/448 X |
| 4,481,768 | 11/1984 | Goshorn et al. | 91/444 X |

FOREIGN PATENT DOCUMENTS 2042716 3/1972 Fed. Rep. of Germany ... 137/552.5

*Primary Examiner*—Edward K. Look

*Attorney, Agent, or Firm*—Robert G. Mentag

[57] ABSTRACT

An air pressure control system for use where a plurality of various sequential and repetitive air pressures are selectively required. A pilot air operated pressure regulator valve having a pilot air operator and a working air flow control valve are connected in series in a pressurized working air conduit between a source of pressurized air and an air cylinder. A pilot air pressure selector circuit means, for selectively and sequentially providing a plurality of pre-set pilot air pressures to the pilot air operator of the pilot air operated pressure regulator valve, includes a plurality of pressurized pilot air conduit means which are connected in parallel with each other, and with one end of each pressurized pilot air conduit means being operatively connected to the source of pressurized air and the other end thereof being operatively connected to the pilot air operator of the pilot air operated pressure regulator valve.

6 Claims, 4 Drawing Figures

SELECTIVE AIR PRESSURE CONTROL SYSTEM FOR WELDING AND LIKE APPARATUS

TECHNICAL FIELD

This invention relates generally to pneumatic control systems, and more particularly, to an improved pressurized air control system for welding and similar applications, for providing a plurality of pre-set output pressures, for operating welding apparatuses in a selective sequence of various pressure welding operations.

BACKGROUND ART

At the present time, industry is using many robot-type welding apparatuses that perform various kinds of welding, and which involve the problem of sequential pressure welding of various thicknesses of metal. The sequential welding of various thicknesses of metals requires a changing of pressures in such welding apparatuses as they sequentially weld various thicknesses of metal. In order to provide the changing working pressures required, for welding such various thicknesses of metal, the welding industry has heretofore employed large selector air valves, with large spring operated regulators, and with each regulator supplying a different set pressure to the large selector air valves. These valves supply multiple pressures for the welds. The disadvantages of the use of such a large spring operated regulator and selector air valve package is that they are expensive, space consuming and inefficient because of the inherent spring rate of the large springs used in such regulators in combination with large selector power valves.

DISCLOSURE OF THE INVENTION

In accordance with the present invention, a selective air pressure control system, for welding apparatuses and the like, is provided for supplying a selective sequence of pre-set pilot air pressures from a pressurized air supply source, for controlling an air cylinder, or the like, for operating welding apparatuses and the like. The air pressure control system includes a pilot air operated pressure regulator valve, and a directional flow control valve, operatively connected in series in a pressurized air conduit means, between a pressurized air supply source and an air cylinder for operating a welding apparatus or the like. A pilot air pressure selector circuit includes a plurality of pressurized air conduit means which are connected in parallel with each other, and with one end of each conduit means being operatively connected to the pressurized air supply source, and the other end thereof being operatively connected to the pilot air operator of the pilot air operated pressure regulator valve. A first one of said plurality of pressurized air conduit means has operatively connected therein a pre-set output pressure regulator valve. Each of the others of said pressurized air conduits has operatively connected therein a pilot air pre-set output pressure regulator valve connected in series with a solenoid operated three-way directional flow control valve, whereby the air cylinder may be selectively supplied with a plurality of pre-set output pressures of pilot air for operating welding apparatuses, and the like, in a selective sequence of various pressure welding operations.

BEST MODE OF CARRYING OUT THE INVENTION

Figures 1, 4:
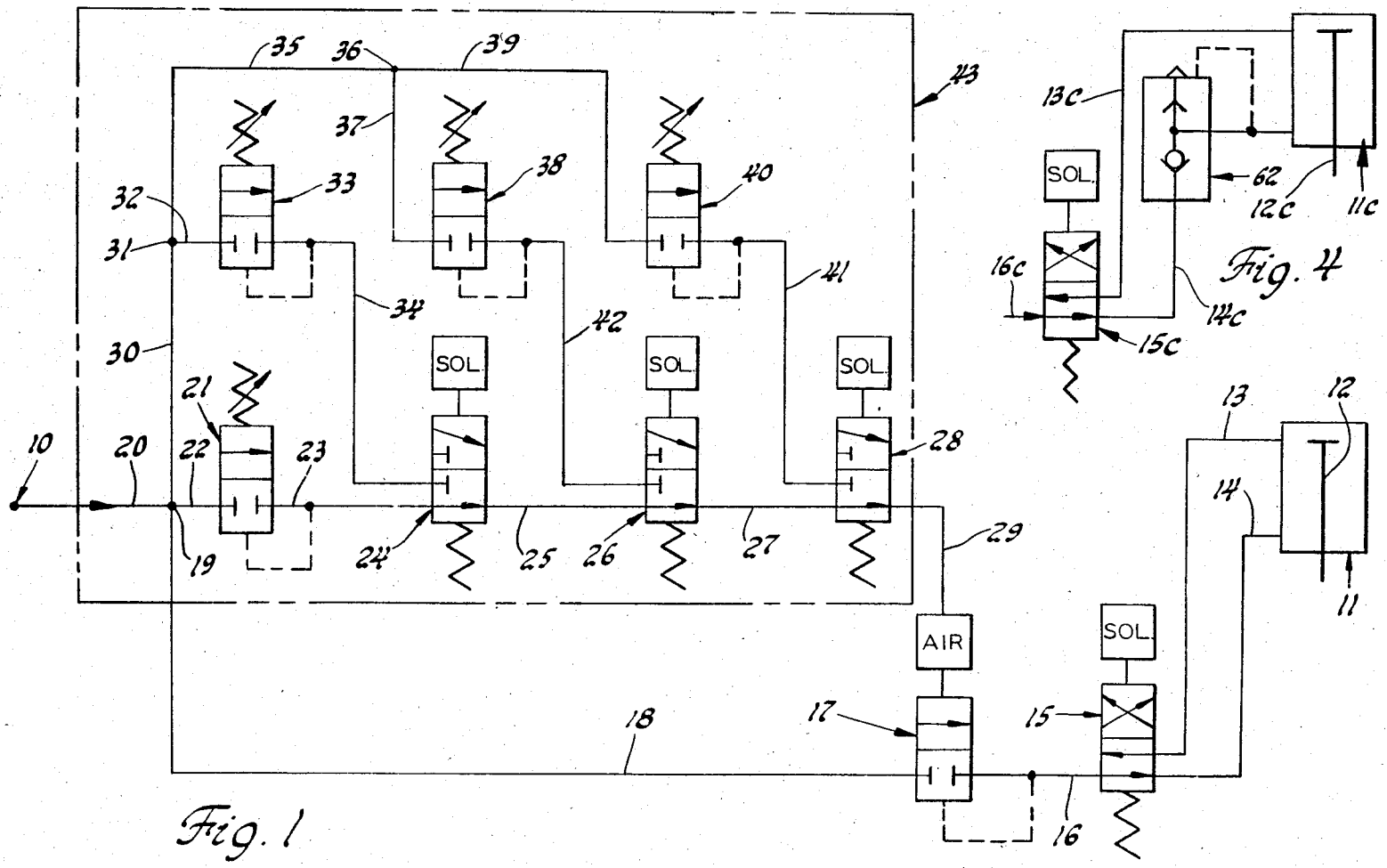
FIG. 1 is a circuit diagram of a selective air pressure control system made in accordance with the principles of the present invention.
FIG. 4 illustrates a quick release valve which may be optionally employed in the air pressure control system illustrated in FIG. 1.

Referring now to the drawings, and in particular to FIG. 1, wherein is shown a first illustrative embodiment of a selective air pressure control system made in accordance with the principles of the present invention, the numeral 10 generally designates a suitable supply source of pressurized air. The numeral 11 generally designates an air cylinder provided with an operating cylinder rod 12 which would be connected to a welding device, or other apparatus to be operated, such as a welding gun, for moving the welding gun into and out of operative pressure contact with workpieces, for pressure welding the same together. The numerals 13 and 14 designate air conduits for conveying pressurized working air to the head and rod ends, respectively, of the cylinder 11, from a solenoid operated, directional flow control valve, generally indicated by the numeral 15. The solenoid operated, directional flow control valve 15 is connected in series to the pressurized air supply source 10 by a pilot air operated, pressure regulator valve, generally indicated by the numeral 17, and suitable pressurized air conduits 16, 18, and 20, and a conduit junction 19. A pilot air pressure selector circuit, generally indicated by the numeral 43, comprises a plurality of pressurized air conduit means which are connected in parallel with each other, and which each have one end operatively connected to the pressurized air supply source 10, and the other end thereof operatively connected to the pilot air operator of the pilot air operated pressure regulator valve 17.

The pilot air pressure selector circuit 43 includes a first spring operated, pressure regulator valve, generally indicated by the numeral 21, which is connected to the pressurized air supply source 10 through the pressurized air conduits 20 and 22, and the conduit junction 19. The pressure regulator valve 21 is connected by a first pressurized air conduit means, which includes the pressure selector circuit pressurized conduits 23, 25, 27 and 29, and a normally open passage through each of three, pressure selector circuit, solenoid operated, three-way flow control valves, generally indicated by the numerals 24, 26, and 28, to the pilot air operator of the pilot air operated, pressure regulator valve 17.

The pressure selector circuit 43 includes a second pressurized air conduit means which is parallel to the first described pressurized air conduit means, and which includes a second spring operated, pre-set output pressure regulator valve, generally indicated by the numeral 33. The regulator valve 33 is connected on one side, by the conduits 32, 30 and 20, and the conduit junctions 19 and 31, to the pressurized air supply source 10. The other side of the pressure regulator valve 33 is connected by the conduit 34 to a normally closed port in a solenoid operated, three-way flow control valve, generally indicated by the numeral 24. When the solenoid operated, three-way flow control valve 24 is operated, it connects the conduit 34, through the conduits 25, 27 and 29, and normally open passageways through the flow control valves 26 and 28, to the pilot air regulator of the pressure regulator valve 17.

The pressure selector circuit 43 includes a third pressurized air conduit means, which is parallel to the first and second described pressurized air conduit means, and which includes a spring operated, pressure regulator valve 38 which is connected from one side, through the conduits 37, 35, 30 and 20, and the conduit junctions 36, 31 and 19, to the pressurized air supply source 10. The other side of the pressure regulator valve 38 is connected by a conduit 42 to a normally closed port of the solenoid operated, three-way flow control valve 26. When the flow control valve 26 is operated, it connects the conduit 42 with the pilot air regulator of the pressure regulator valve 17 through the conduits 27 and 29, and a normally open passageway through the flow control valve 28.

The pressure selector circuit 43 includes a fourth pressurized air conduit means, which is parallel to the first, second and third described pressurized air conduit means, and which includes a spring operated pressure regulator valve, generally indicated by the numeral 40, which has one side connected through the conduits 39, 35, 30 and 20, and the conduit junctions 36, 31 and 19, to the pressurized air supply source 10. The other side of the pressure regulator valve 40 is connected to a normally closed port of a third solenoid operated, flow control valve 28. When the flow control valve 28 is operated, it then connects the conduit 39 to the pilot air operator of the pressure regulator valve 17 through the conduits 41 and 29, and a passageway through the solenoid operated, flow control valve 28.

Any suitable solenoid operated, directional flow control valve may be employed to carry out the function of the four-way flow control valve 15, such as a flow control valve available on the market from MAC Valves, Inc. of 30569 Beck Road, Wixom, Mich. 48096, under Model No. 6511A-211-PM-111D. Any suitable pilot air operated regulator valve may be employed for carrying out the function of the regulator valve 17, such as a pilot operated, pressure regulator valve available on the market from the Watts Regulator Co. of 12 Embankment St., Lawrence, Mass. 01842, under Model No. 119-04X20. Any suitable spring operated, pressure regulator valve may be employed for carrying out the regulator valve function of the pressure selector circuit regulator valves 21, 33, 38 and 40, such as a regulator valve available on the market from the MAC Valves, Inc., under Model No. 251B-XXYBA. Another suitable spring operated, pressure regulator valve which may be employed for carrying out the regulator valve function of the regulator valves 21, 33, 38 and 40 is a regulator valve available on the market from Wabco Fluid Power Division of American-Standard, of 1953 Mercer Road, Lexington, Ky. 40506, under Model No. PR 7567-21001. Any suitable solenoid operated, three-way valve may be employed for carrying out the function of the solenoid operated, flow control valves 24, 26 and 28, such as a flow control valve available on the market from MAC Valves, Inc. under Model No. 257B-111B Mod. 323A.

In operation, it will be seen, that the small pressure of the regulator pressurized air acting as pilot air, on the pilot air operator of the pressure regulator valve 17, determines the regulated pressure of the air conveyed through the pressure regulator valve 17 to the directional flow control valve 15 and to the welding apparatus air cylinder 11. Accordingly, the small pilot air pressure directed to the pilot air operator of the pressure regulator valve 17 regulates the larger working air pressure exerted by the air cylinder 11.

As shown by FIG. 1, the spring operated, regulator valve 21 permits a first small or low pre-set output pilot air pressure to be conveyed to the pilot air operator regulator of the regulator valve 17, for operating the same to feed a first larger operating pressure through the control valve 15 to the air cylinder 11. Various pre-set output pilot air pressures can be conveyed to the pilot air operator of the regulator valve 17 by selectively and sequentially operating the solenoid operated, flow control valves 24, 26 and 28, as required for predetermined welding operations. When the solenoid valve 24 is operated, it blocks off the flow of pilot air through the conduit 23, and permits the pre-set output of pressurized pilot air flowing from the regulator valve 33 to be conducted to the pilot air operator of the regulator valve 17. When the solenoid valve 26 is operated, it blocks off the pilot air flowing through the conduit 25, and permits another pre-set output of pressurized pilot air to flow from the regulator valve 38 to the pilot air operator of the regulator valve 17. When the solenoid valve 28 is operated, it blocks the flow of pilot air through the conduit 27 and permits a further pre-set output of pressurized pilot air to flow from the regulator valve 40 to the pilot air operator of the regulator valve 17. It will be understood that the solenoid valves 15, 24, 26, and 28 may be operated in any desired sequence, by any suitable means, such as an electrical control circuit.

It will be seen that the working or operating air pressure control system illustrated in FIG. 1 permits the quick and efficient changing of working air pressures fed to the welding apparatus air cylinder 11, by quick and simple operations of the small solenoid operated, control valves 15, 24, 26 and 28, and the flow of low or small pilot air from the regulator valves 21, 33, 38 and 40. The working air pressure control system of FIG. 1 eliminates the need for the prior art large and expensive selector valves, with the pressure loss which is inherent in the use of such valves.

Figure 2:
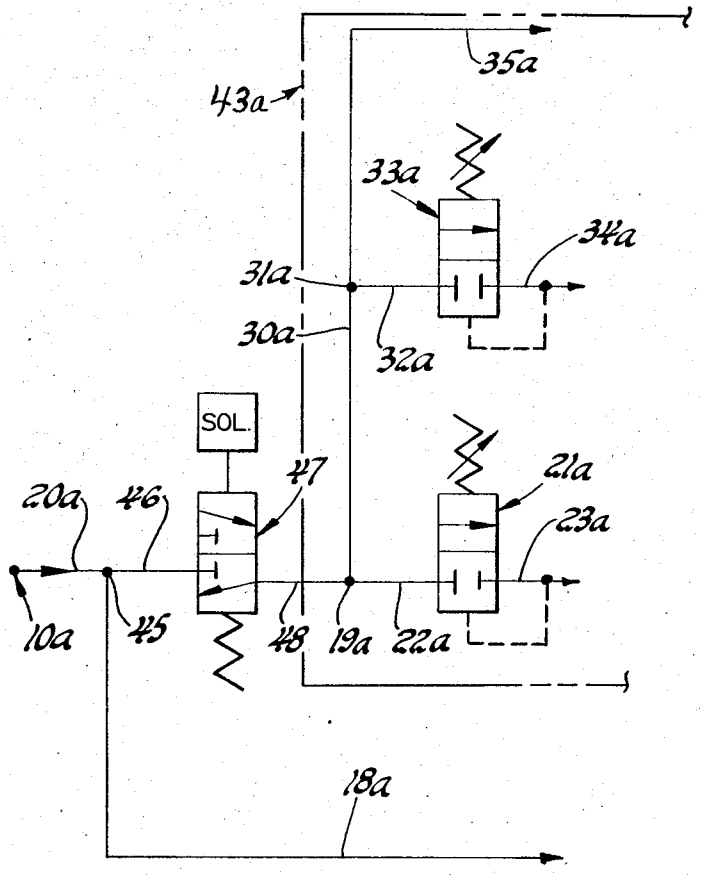
FIG. 2 is a modification of the circuit diagram of FIG. 1, and showing an addition of a shut-off valve which may be employed with the selective pilot air control system of FIG. 1.

FIG. 2 illustrates the addition, to the air pressure control system of FIG. 1, of a safety shut-off valve, generally indicated by the numeral 47. The shut-off valve 47 is an electrical solenoid operated, three-way flow control valve which is connected on one side by a conduit 46, a conduit junction 45, and a conduit **20*a* to the pressurized air supply source 10*a*. The conduit junction 45 would be connected to the line 18*a* which would be connected to the pilot air operated pressure regulator valve 17. The other side of the shut-off valve 47 is connected by a conduit 48 to the conduit junction 19*a*. The connective parts of the circuit structure of FIG. 1 which would be operatively connected to the shut-off valve 47 are designated by the same reference numerals as used in the circuit diagram of FIG. 1**, followed by the small letter "a".

It will be seen that, when the solenoid operated, shut-off valve 47 is in the de-energized position shown in FIG. 2, the flow of pressurized pilot air from the supply source 10*a* through the pressure regulator valves 21*a*, 33*a*, 38*a* and 40*a* is shut off. When the shut-off valve 47 is energized, the pressurized pilot air from the supply source 10*a* is permitted to flow into the pressure selector circuit FIG. 1 to pressurize said regulator valves. It will be understood that there are large air pressure leakage losses in the overall structure of welding equipment, and that by shutting off the pressurized pilot air to the pressure selector circuit portion 43*a* of the control circuit of FIG. 1, when the welding equipment is not being used, that the loss of pressurized air is prevented and energy conserved. Any suitable shut-off valve may be employed for carrying out the function of the shut-off valve 47, such as a shut-off valve available on the market from MAC Valves, Inc. under Model No. 225B-111B.

Figure 3:
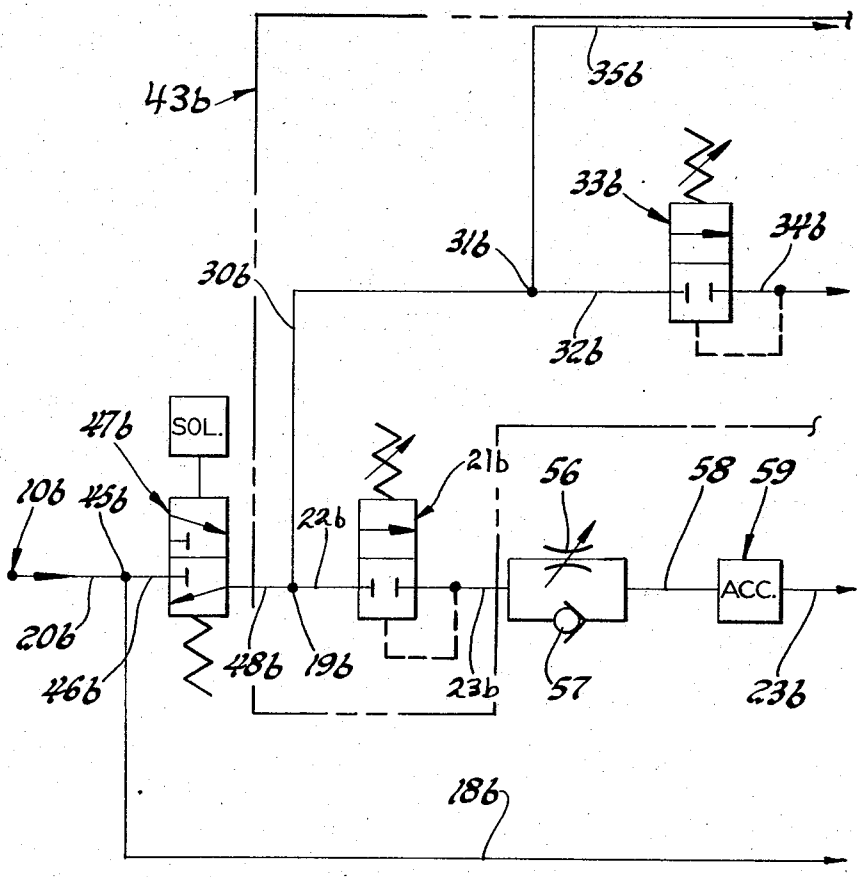
FIG. 3 illustrates a modification of the pilot air pressure control system illustrated in FIG. 1 which includes a flow control accumulator valve for providing a slow increase in pressure in the control system, to prevent damage to the welding apparatus being controlled by the control system, due to any fast build-up of pressure in the control system.

FIG. 3 illustrates the modifying of the air pressure control systems illustrated in FIGS. 1 and 2, by adding additional elements for providing a slow increase in pilot air pressure in the control system, to prevent damage to the welding apparatus or similar apparatus being controlled by the control system, due to a fast build-up of pilot air pressure in the control system.

As shown in FIG. 3, the circuit elements of FIGS. 1 and 2 which are operatively connected to the structure of FIG. 3 are illustrated by the same reference numerals as used in FIGS. 1 and 2, followed by the small letters "b". The modified embodiment of FIG. 3 includes a safety shut-off valve 47*b*. The circuit structure added in FIG. 3 includes an adjustable flow control valve 56 which is mounted in parallel with a ball check valve 57 in the conduit 23*b*. An accumulator 59 is also mounted in the conduit 23*b*, and it is connected in series by a conduit 58 to the parallel structure of the adjustable flow control valve 56 and the check valve 57.

It will be seen that the added circuit structure of FIG. 3 permits the pilot air pressure initially passing through the first pressure regulator valve 21*b* to the pilot air operator of the regulator valve 17 to be built-up in a slow fashion, so as to prevent a quick build-up of pilot air pressure with a resultant destructive action to the welding equipment being controlled by the control circuit. The addition of the adjustable flow control valve 56, the accumulator 59, and the check valve 57 in the circuit between the first regulator valve 21 and the pilot air regulator valve 17 permits a slow and efficient build-up of pressure in that part of the circuit. In the past, in order to prevent a quick build-up of pressures in like control systems, big lock-out valves have been used, but it has been found that they are costly and involve other problems. For example, when such big lock-out valves are turned on, any leftover loads in the system move back when the air is shut off, and when the air is turned on, there is no air in the system to control such loads.

The accumulator 59 may be of any suitable type. The check valve 57 may be any suitable ball check valve. The adjustable flow control valve 56 may be any suitable flow control valve, such as a flow control valve available on the market from Deltrol Fluid Products, Grant and 30th Aves., Bellwood, Ill. 60104, under Model No. EFL-305.

FIG. 4 illustrates a quick release valve which may be optionally used in the control circuit of FIG. 1. The parts of the control circuit structure in FIG. 4 which are the same as the same parts employed in the circuit structure of FIG. 1 are marked with the same reference numerals followed by the small letter "c". In FIG. 4, a quick release valve, generally indicated by the numeral 62, is shown as being optionally mounted in the conduit line 14*c*, between the rod end of the air cylinder 11*c* and the solenoid operated flow control valve 15*c*. The quick release valve 62 functions as a dump valve to quickly exhaust the pressurized working air in the rod end of the cylinder 11*c*.

While it will be apparent that the preferred embodiments of the invention herein disclosed are well calculated to achieve the results aforestated, it will be appreciated that the invention is susceptible to modification, variation and change.

INDUSTRIAL APPLICABILITY

The air pressure control system of the present invention is adapted for use in industrial air use applications where a plurality of sequential and repetitive air pressures are required, as in the control of welding and similar apparatuses.

I claim:

1. An air pressure control system for supplying various selective, sequential pre-set air pressures from a source of pressurized air to an air cylinder or the like, for operating welding and similar apparatus, characterized in that it includes:

(a) a pilot air operated pressure regulator valve having a pilot air operator and a working air flow control valve operatively connected in series in a pressurized working air conduit means between said source of pressurized air and said air cylinder;

(b) a pilot air pressure selector circuit means connected between said source of pressurized air and the pilot air operator of said pilot air operated pressure regulator valve, for selectively and sequentially providing a plurality of small pre-set pilot air pressures to the pilot air operator of said pressure regulator valve, for operating the pressure regulator valve to selectively and sequentially supply a plurality of larger pre-set working pressures to said flow control valve and thence to said air cylinder for operating said air cylinder in a sequence of various pressure operations;

(c) said pilot air pressure selector circuit means including a plurality of pressurized pilot air conduit means which are connected in parallel with each other, with one end of each pressurized pilot air conduit means being operatively connected to said source of pressurized air and the other end thereof being operatively connected to the pilot air operator of said pilot air operated pressure regulator valve;

(d) a first one of said plurality of pressurized pilot air conduit means has operatively connected therein a pre-set output pressure regulator valve; and, (e) each of the others of said pressurized pilot air conduits has operatively connected therein a pre-set output pressure regulator valve connected in series with a solenoid operated directional flow control valve.

2. An air pressure control system for operating welding and similar apparatuses as defined in claim 1, characterized in that:

(a) each of said pre-set output pressure regulator valves is a spring operated valve.

3. An air pressure control system for operating welding and similar apparatuses as defined in claim 1, characterized in that:

(a) each of said solenoid operated directional flow valves, is a three-way valve.

4. An air pressure control system for operating welding and similar apparatuses as defined in claim 1, characterized in that:

(a) a solenoid operated shut-off valve is operatively mounted in said system between said source of pressurized air and said plurality of pressurized pilot air conduit means.

5. An air pressure control system for operating welding and similar apparatuses as defined in claim 4, characterized in that:

(a) a flow control valve means and a check valve are connected in parallel with each other, and an accumulator is connected in series therewith, in said first one of said plurality of pressurized pilot air conduit means, downstream of said pre-set output pressure regulator valve in said first one of said plurality of pressurized pilot air conduit means, to provide a slow increase of pilot air pressure in said last mentioned pressurized pilot air conduit means when flow of the pilot air is inward to the pilot air operator of the pilot air operated pressure regulator valve, and to provide a quick exhaust of pilot air when flow of the same is outward in said last mentioned pressurized pilot air conduit means.

6. An air pressure control system for operating welding and similar apparatuses as defined in either one of claims 1, 4 or 5, characterized in that:

(a) a quick release valve is mounted in said working air conduit means, between the working air flow control valve and the air cylinder.

* * * * *